United States Patent [19]

Ekornes

[11] 3,934,932

[45] *Jan. 27, 1976

[54] ADJUSTABLE CHAIR

[75] Inventor: Jostein Ekornes, Ikornes, Norway

[73] Assignee: J.E. Ekornes Fabrikker A/S, Ikornes, Norway

[ * ] Notice: The portion of the term of this patent subsequent to Nov. 20, 1990, has been disclaimed.

[22] Filed: Sept. 24, 1973

[21] Appl. No.: 400,446

Related U.S. Application Data

[63] Continuation-in-part of Ser. No. 193,430, Oct. 28, 1971, Pat. No. 3,773,383.

[52] U.S. Cl. ..... 297/320; 297/342; 297/355

[51] Int. Cl.[2] ..... A47C 1/032

[58] Field of Search ..... 297/29, 316, 317, 320, 297/321, 340–343, 355, 422

[56] References Cited

UNITED STATES PATENTS

| | | | |
|---|---|---|---|
| 2,400,588 | 5/1946 | McArthur | 297/320 X |
| 2,591,911 | 4/1952 | Block | 297/316 |
| 2,617,471 | 11/1952 | Lorenz | 297/321 X |
| 3,337,266 | 8/1967 | Burns | 297/317 |
| 3,773,383 | 11/1973 | Ekornes | 297/320 |

FOREIGN PATENTS OR APPLICATIONS

| | | | |
|---|---|---|---|
| 154,892 | 1/1954 | Australia | 297/320 |

*Primary Examiner*—Roy D. Frazier
*Assistant Examiner*—William E. Lyddane
*Attorney, Agent, or Firm*—Nolte and Nolte

[57] ABSTRACT

A chair provided with frictional coupling means for use in adjusting the relative angular position of the seat and the back thereof relative to each other.

5 Claims, 4 Drawing Figures

ADJUSTABLE CHAIR

This application is a continuation-in-part of parent application of Jostein Ekornes, Ser. No. 193,430, for "Readjustable Chair" filed Oct. 28, 1971, now U.S. Pat. No. 3,773,383.

This invention relates to an improved adjustable chair.

More particularly, this invention relates to the aforesaid chair having securing means of the frictional variety for use in varying the angular positioning of the seat and back thereof relative to each other.

There are many and varied adjustable chairs in the art. In some, the back and the seat are suspended on a framework and, in others, such elements are supported in such a manner that the aforesaid parts may be brought, if desired, to a proper angular position relative to each other. However, securing such a chair in the desired position from day to day is quite difficult, usually requiring many and varied complicated and expensive parts or equipment, the latter being ancillary to the two main parts of the chair. As a result, the manufacture of such equipment is rather expensive and the manual adjustment or operation of such equipment is again quite complicated.

The subject invention answers the needs of the art with special emphasis on an effective means of the frictional variety, in the form of an adjustable coupling for use in adjusting the angle and position of both the seat and the back to one another, in an efficient and facile manner.

It is therefore an object of this invention to provide a chair means for the angular adjustment of the back and the seat thereof in an effective manner relative to each other.

Another object is to provide means for the angular adjustment of the position of a chair where the seat and the back thereof are connected in a hinge-like manner to each other.

Other objects and many of the attendant advantages of this invention will become more apparent to one skilled in the art from a reading of the following detailed specification taken with the drawings, wherein.

Figure 1:
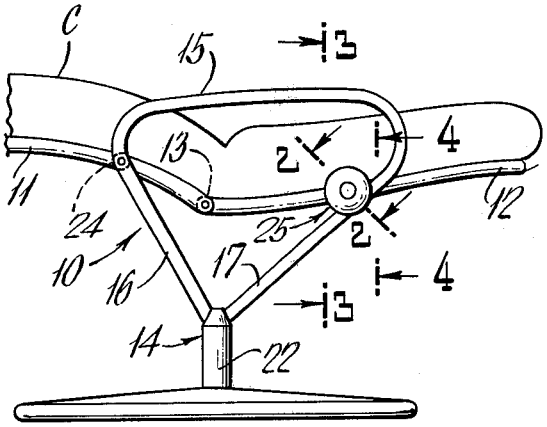
FIG. 1 is a side view, partially broken away, of a chair of the present invention.

As shown in FIG. 1, a chair 10 is provided with frames 11 and 12 which are connected to each other in a hinged manner by trunnions 13 and thus may be adaptable to many and varied angular positions relative to each other. Frame 11 forms the foundation of the back of the chair and is provided with adequate cushioning C for a back rest, while frame 12 forms the basis for a seat upon which a second cushion may be provided or, as shown, the cushioning may cover both frames. The chair 10 is supported on a base 14 from the central upright 22 of which chair supports extend on either side of the chair. These supports each comprise upwardly diverging rear 16 and front 17 portions and section 15 functioning as an arm rest extending therebetween.

The lower portion of the frame 11 is connected in a pivotal manner, for example, via trunnions 24, to the rear portion 16 of the support 14 at a substantially near-adjacent position relative to the hinge between frames 11 and 12 as shown. The frame 12, which functions as a seat, is connected to the front portion 17 of the support 14.

The engagement of the front portion 17 to frame 12 is frictional and slidable by movable slide shoes 25 which are secured to the frame 12 but which are adapted to allow it and the front support portion 17 to slide relative to one another. Each of the shoes is provided with an adjustment wheel 28 which are adjustable to increase or vary the frictional coupling between the slide shoes 25 and the front portion 17 of the support 14.

Thus, the seat and back of the chair are arranged to be in a state of static equilibrium, whatever the relative angular position of such elements one to the other, when a person is not sitting in the chair. However, when a person is sitting in the chair, the chair can also remain in static equilibrium in any state desired by the sitter without using the adjustment wheels to lock the chair in position. The relative angular positions of the seat and back can be altered by the sitter without adjusting the slide shoes. However, the adjusting force required to be applied by a sitter to adjust the position can be selected by use of the adjustment wheels to vary the frictional coupling between the slide shoes and the front supports. In effect, this latter action is the adjustment of the degree of equilibrium of the chair wherein absolute and stable equilibrium is reached when the friction between the slide shoes and the front support portion is so large that they are unable to move relative one to the other. Note should also be taken that the adjusting force is more or less constant throughout the range of angular adjustment.

Figure 4:
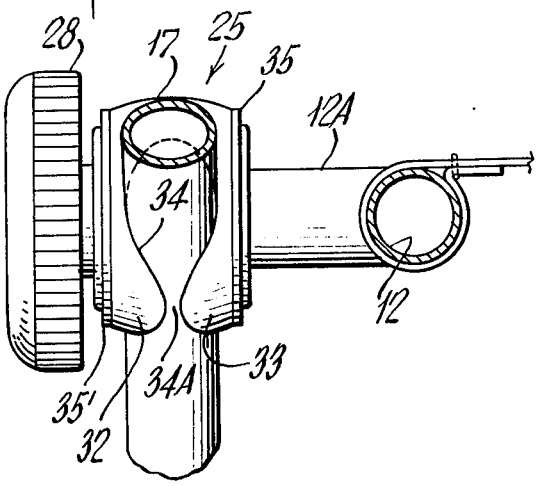
FIG. 4 is a front view, partially in section, of the coupling device taken on line 4—4 of FIG. 1.
Figure 3:
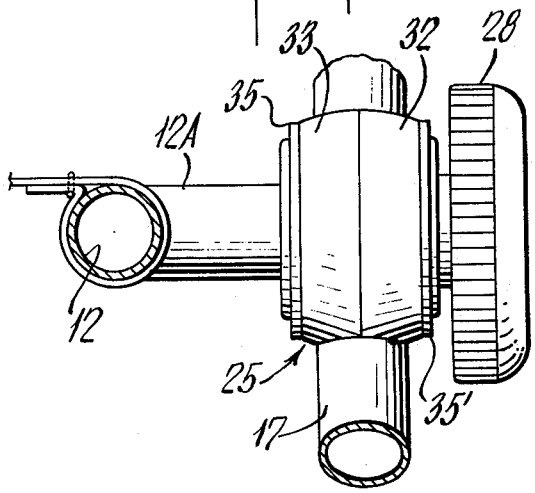
FIG. 3 is a rear view, partially in section, of the coupling device taken on line 3—3 of FIG. 1.
Figure 2:
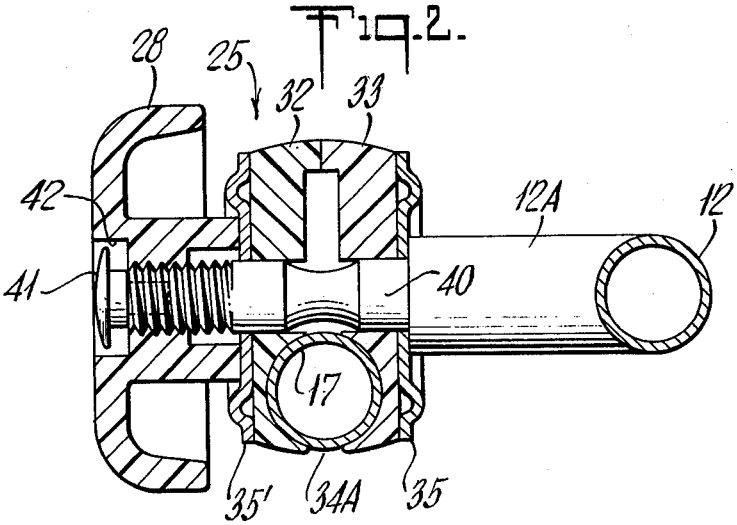
FIG. 2 is a sectional view of the coupling device taken on line 2—2 of FIG. 1.

As shown in FIGS. 2–4, each slide shoe 25 provides a pair of opposed discs 32, 33 made of a durable hard rubber or plastic, such as nylon, the inner surfaces of which, when pressed together, frictionally engage one another and frictionally engage front support portion 17 within a saddle area 34 shaped to tightly conform to the shape of portion 17, and advantageously providing a cut-away portion 34A so that the slide shoe assembly need not be completely disassembled for disposition on portion 17.

The discs 32, 33 are held in opposed position by clamp members 35, 35' which are loosely mounted on shaft 40 and axially confined by the outer edge of tubular extension 12A of frame 12 and inwardly extending hub of wheel 28, respectively.

The inner end of shaft 40 is rigidly secured within the tubular extension 12A via any convenient means, not shown, as by welding prior to extension 12A being secured to frame 12, also by welding, for example. The outer end of shaft 40 is threaded for engaging inwardly threaded wheel 28 for axial movement of the wheel along the shaft to tighten and loosen the clamps 35, 35'. The outer end of shaft 40 has a threaded female recess (not shown) for receiving retainer bolt 41 which provides at the inner surface of its head a stop for inhibiting axial movement of the wheel at the end of the unthreaded portion of the stem of bolt 41 which is larger than the threaded portion (not shown) and sits on the outer end of shaft 40 within a recess 42 in wheel 28.

With the adjustable chair described above, one can easily control the position of the chair, i.e., the angular position between the back and seat, merely by suitable weight transfer of the body. The chair can be locked in a desired position simply by suitably adjusting the locking wheels, and all adjustments may thus be done while one sits in the chair; there are not any details existing which may initiate wedging of fingers, clothes and the like. The construction of the chair is simple and also no disfiguring parts are present.

Also note that the chair is so arranged that the center of gravity of the chair, or of the chair plus a person sitting in it, remains substantially in the same vertical line, which is a line through the upright column.

There are several alternates which will become apparent to one skilled in the art from the above description taken with the drawings. For instance, the cushioning may, if desired, be designed as one unit or it may be designed as two separate and detachable units. Additionally, cushioning may also be provided for the horizontal section of the support to function as an arm rest, if so desired.

What is claimed is:

1. In an improved adjustable chair having a seat and back hingedly connected together and two supports, one at each side of said chair, such supports for use in adjusting the relative angular position of both said seat and said back to each other, each of such supports having a front and a rear portion, each of said rear support portions being pivotally connected to a side of said back, the improvement comprising two adjustable coupling units of the frictional variety, each unit being affixed to a separate side of the seat, and each unit being linearly slidable along one of said front support portions to allow the seat to move upwardly and forwardly and to move downwardly and backwardly for the adjustment of said angular position, each of said units being adjustable by frictional coupling to establish such an equilibrium position along said front supports that shifting of loading on said chair will move the seat and back relative to said supports to another position of similar equilibrium, the distance between the units and the axis about which the back and seat are hinged together being fixed, said coupling units being provided with opposed sections, defining surfaces therebetween for frictional engagement with and sliding movement along said front support portions, and means for moving said opposed sections towards and away from each other to vary the friction between said surfaces and said front support portion.

2. The adjustable chair of claim 1, wherein the pivotal connection of each rear support portion to the side of the back is at a point substantially nearer to the hinge connection of the seat and the back than to the free end of the back.

3. The adjustable chair of claim 2, wherein the seat is inclined at a substantially constant angle relative to the ground regardless of the relative angular position of the seat and back.

4. The adjustable chair of claim 3, wherein said support portions support an arm rest.

5. The adjustable chair of claim 4, wherein said front support portions are elongate and extend upwards and forwards at a substantially constant angle relative to the ground.

* * * * *